US009878260B1

(12) United States Patent
Chen

(10) Patent No.: US 9,878,260 B1
(45) Date of Patent: Jan. 30, 2018

(54) INTERLINKING ASSEMBLY DEVICE

(71) Applicant: Cecilia Chen, East Brunswick, NJ (US)

(72) Inventor: Cecilia Chen, East Brunswick, NJ (US)

( * ) Notice: Subject to any disclaimer, the term of this patent is extended or adjusted under 35 U.S.C. 154(b) by 0 days.

(21) Appl. No.: 15/435,403

(22) Filed: Feb. 17, 2017

Related U.S. Application Data

(60) Provisional application No. 62/296,904, filed on Feb. 18, 2016.

(51) Int. Cl.
*A63H 33/16* (2006.01)
*A63H 33/10* (2006.01)
*A63H 33/00* (2006.01)

(52) U.S. Cl.
CPC ..... *A63H 33/16* (2013.01); *A63H 33/10* (2013.01)

(58) Field of Classification Search
CPC . A63H 3/00; A63H 3/52; A63H 27/00; A63H 33/00; A63H 33/18; A63H 33/10; A63H 33/16
USPC .... 446/71, 80, 102, 104, 108–109, 486–487
See application file for complete search history.

(56) References Cited

U.S. PATENT DOCUMENTS 535,908 A * 3/1895 Kierolf ..... A63H 33/00 446/115
4,122,626 A * 10/1978 Waters ..... A63H 27/00 446/71
4,911,670 A * 3/1990 McNicholas ..... A63H 3/52 434/429
5,797,815 A * 8/1998 Goldman ..... A63H 33/18 446/46
7,395,621 B2 * 7/2008 Carter ..... G09F 1/00 229/115

* cited by examiner

*Primary Examiner* — Kien Nguyen
(74) *Attorney, Agent, or Firm* — Werschulz Patent Law, LLC

(57) ABSTRACT

An interlinking assembly device for generating three-dimensional objects. The device includes a unit having a pair of wings and at least one loop. The wings have slots that can accept a wing from another unit. The at least one loop can also accept a wing from another device, allowing multiple rows to be linked and extend in three dimensions. A kit includes more than one unit and can include more than one embodiment of the unit.

8 Claims, 9 Drawing Sheets

INTERLINKING ASSEMBLY DEVICE

CROSS-REFERENCE TO RELATED APPLICATIONS

This application is a nonprovisional utility application of the provisional patent application, Ser. No. 62/296,904 filed in the United States Patent Office on Feb. 18, 2016 and claims the priority thereof and is expressly incorporated herein by reference in its entirety.

TECHNICAL FIELD

The present disclosure relates generally to an interlinking assembly device. More particularly, the present disclosure relates to an interlinking assembly unit and a kit thereof configured for creating three-dimensional craft objects.

BACKGROUND

Folding paper, foil, plastic and other types of sheets to form both beautiful and useful objects is a well-known craft called origami. A simpler folk craft based on small sheets or strips to form straight chains is well-known. Often these small strips are candy or gum wrappers that are being repurposed. Folding and forming chains produce only linear objects that are transformed into belts, bracelets and the like.

Slightly more elaborate objects such as the "candy wrapper purse" require an additional step to form an object that is in three dimensions, since these chains are linear and build in a unidimensional manner. The chains are formed into circles and the circles are joined one to the other by sewing, gluing or another attachment method to build in another dimension. This is a clumsy and inelegant solution to the unidirectional growth of the lines.

This folk craft requires that all links be folded out of paper, plastic or foil wrappers or sheets and are very difficult and time-consuming to make. Additionally, they slip and have problems with uniformity, which makes them difficult to link together. Moreover, it is difficult to make the units by hand, and there is no way to make sheets, so circles must be joined together by sewing or gluing. Moreover, the process of making individual assembly units out of paper is extremely tedious and requires dexterity, patience and time. Thus, there is a need for a simple device for creating interlinking objects or assembly units that does not require folding, and requires less dexterity, patience and time.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide an interlinking device that assembles in multiple directions. Accordingly, an aspect of an example embodiment in the present disclosure provides a plurality of units having both a plurality of slots and a plurality of loops for connecting one to the other.

Another aspect of an example embodiment in the present disclosure is to provide an interlinking device the assembles sheets and bands. Accordingly, the present disclosure provides a plurality of units having a plurality of loops orthogonal to the slots such that the units connect in three dimensions, allowing two-dimensional sheets and three dimensional containers defining a volume to be constructed.

The present disclosure describes an interlinking assembly device for generating three-dimensional objects. The device includes a unit having a pair of wings and at least one loop. The wings have slots that can accept a wing from another unit. The at least one loop can also accept a wing from another device, allowing multiple rows to be linked and extend in three dimensions. A kit includes more than one unit and can include more than one example embodiments of the unit.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
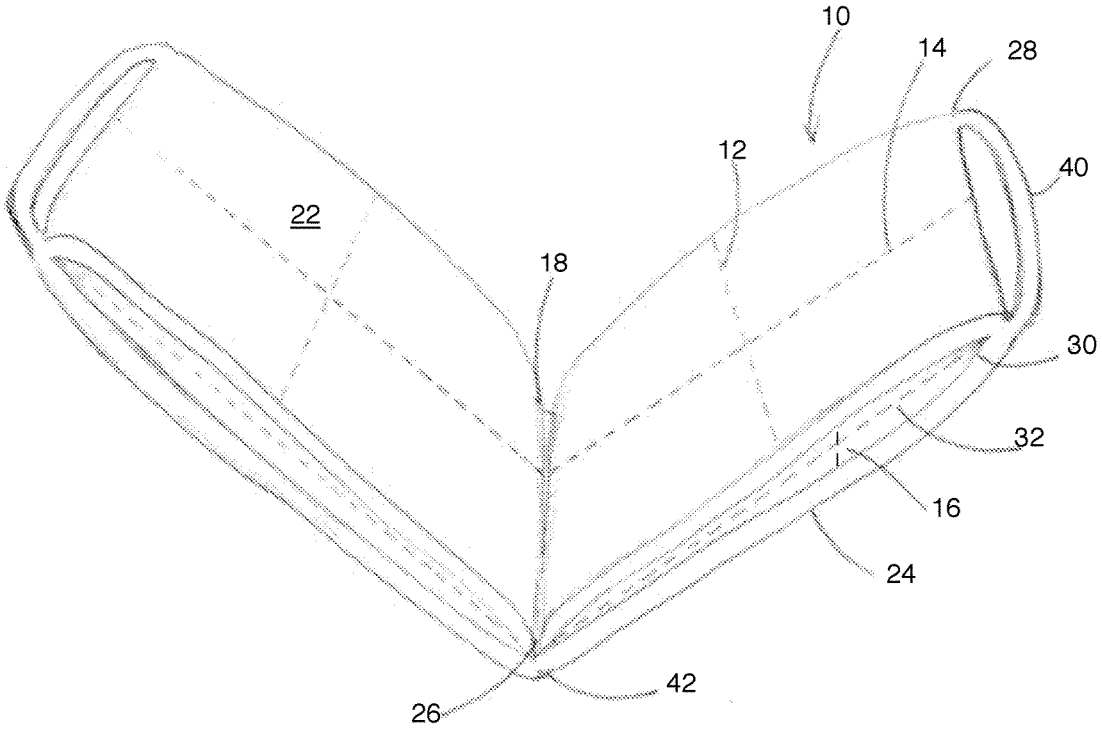
FIG. 1 is a perspective view of an example embodiment of a closed interlinking assembly unit.

FIG. 1 illustrates an example embodiment of a unit 10 of an interlinking assembly device of the present disclosure. The interlinking assembly device is useful for creating a plurality of objects for amusement and play as well as useful and decorative objects typical of folk crafts. The unit 10 when connected with other identical units or other units described hereinbelow form objects that extend in three dimensions as the user adds more and more units, allowing the user to create limitless new designs and patterns.

The unit 10 has a pair of substantially identical wings 20 hingedly connected. Each wing has an upper end 28, a lower end 26 and a lateral axis 12, the lower end 26 connecting at a hinge 42. Each wing 20 has a through slot 30 extending from the upper end 28 to the lower end 26. The slot 30 has a longitudinal axis 32 approximately twice the lateral axis 12 of the wing 20. A loop 40 attaches to each wing 20 at the upper end 28.

The term "hinge" is defined as a movable joint on which a wing swings as it opens and closes, the joint connecting the wings and not necessarily a mechanism of multiple parts.

Figure 2:
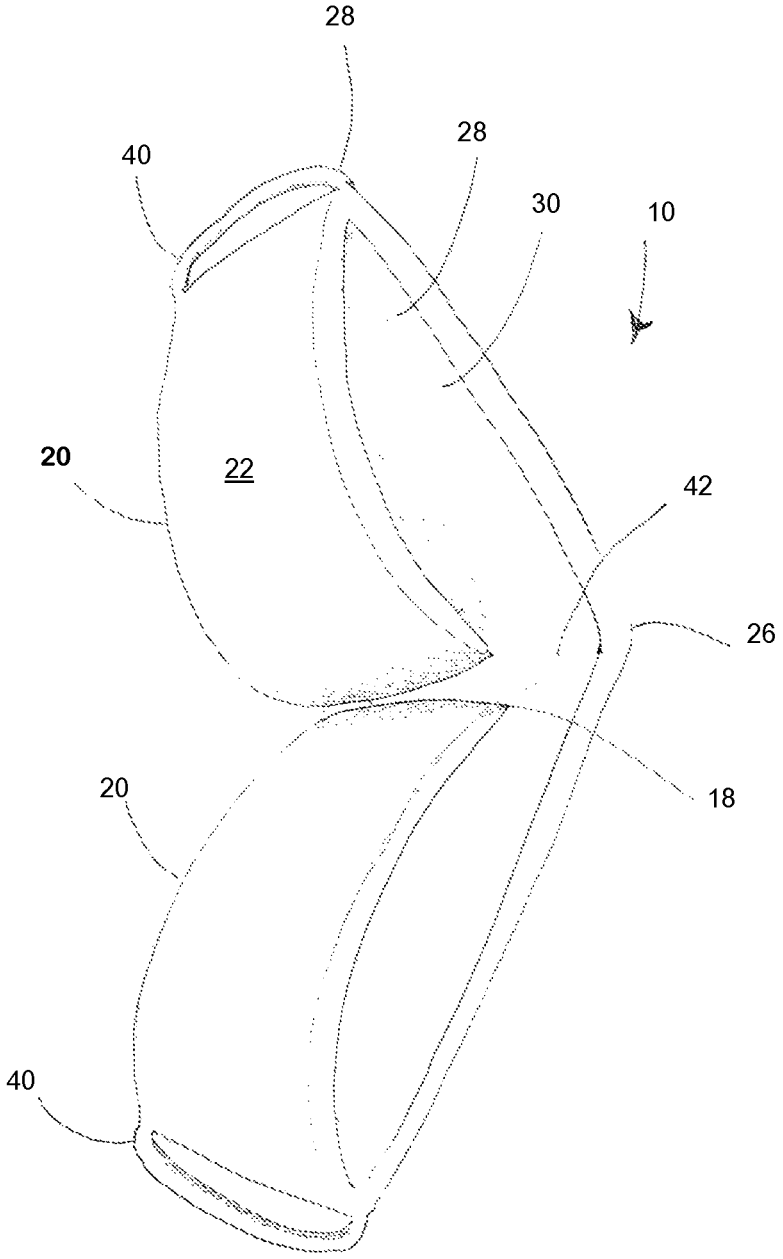
FIG. 2 is a perspective view of an example embodiment of an open interlinking assembly unit.

FIGS. 1 and 2 shows an example embodiment of how the wings 20 are formed. In this example embodiment, the unit 10 is formed by folding a strip 11 of flat material having the longitudinal axis 14 approximately eight times the lateral axis 12 of the strip 11. Further, if the longitudinal axis 14 is less than eight times the lateral axis 12, the strip 11 may be folded along the longitudinal axis 14 until the lateral axis 12 is approximately one-eighth the longitudinal axis 14.

The strip 11 has a pair of distal edges 18. The unit 10 is formed by folding the strip 11 approximately halfway along the longitudinal axis 14 forming the hinge 42 and by folding the distal edges 18 inwardly toward the hinge 42, forming the wings 20. The distal edges 18 selectively attach to the hinge 42. At least one loop 40 is attached to the unit 10.

The strip 11 is made from flexible material such paper, plastic or metal foil or similar materials that are sufficiently flexible and slightly elastic to fold or bend but sufficiently firm to retain its shape. The specific type of material is not a limitation, providing that it complies with the criteria herein disclosed. The loop may be made from the same material as the wings or a different material and this is not a limitation.

In another example embodiment, the unit is a unitary piece formed by 3-D manufacturing also known as additive manufacturing. In a further example embodiment, the unit is molded by such processes as injection molding, extrusion molding or thermoforming. The method of forming the unitary piece is not a limitation.

Figure 3:
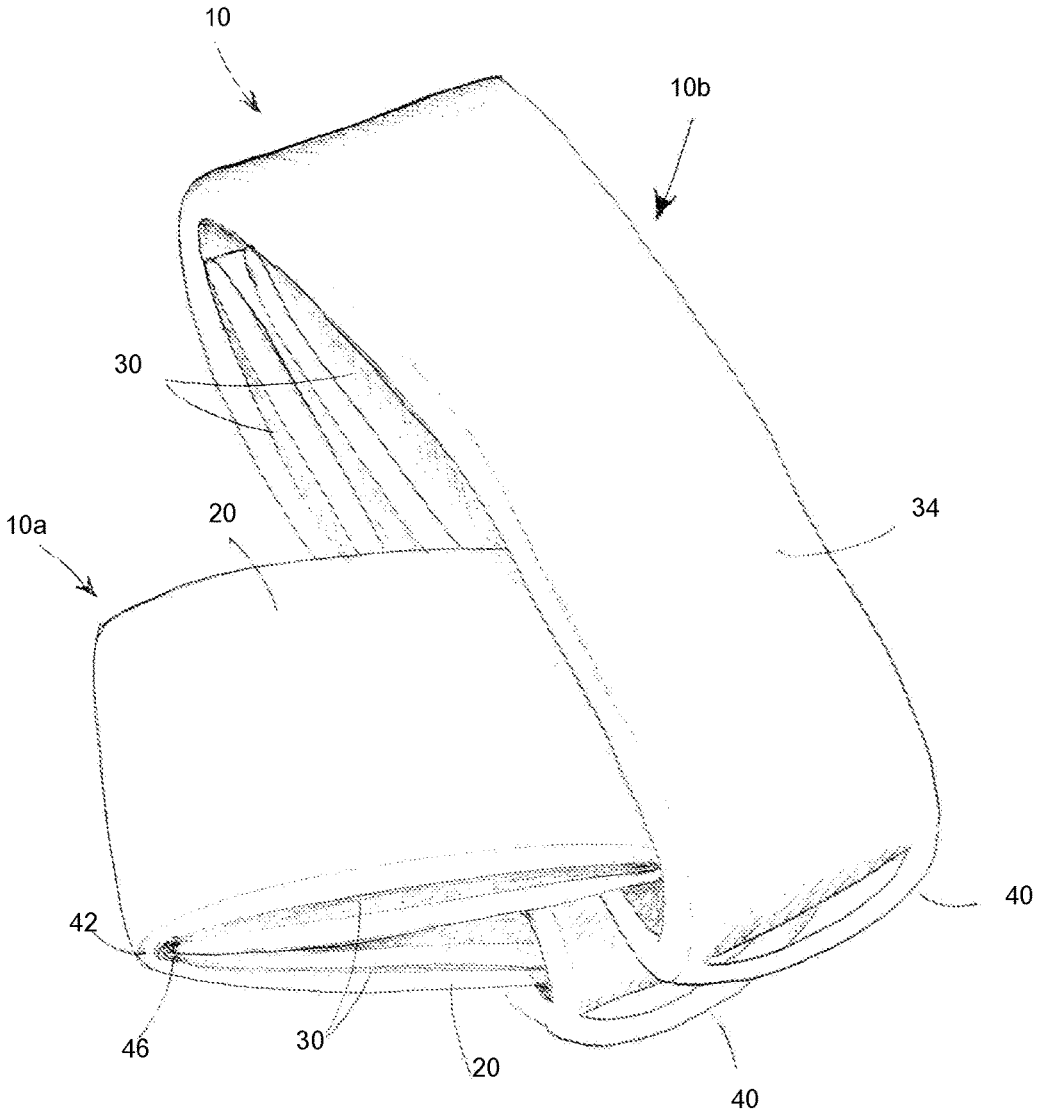
FIG. 3 is a perspective view of an example embodiment of a pair of interlinking assembly units.

FIG. 3 shows two interlinking units 10 joining together, forming a beginning for a chain. Each wing 20 of a first unit 10*a* is passed through one slot 30 in a second unit 10*b*. The first unit 10*a* is passed through until an inner hinge surface 46 reaches an edge 34 of the wing 20 of the second unit 10*b*. If additional units are added in this manner, the object formed would extend unidirectionally, only in a linear direction by simply joining the units. However, the loops 40 of the units 10*a*, 10*b* allow additional units to be joined in directions that are orthogonal to the linear chain shown in FIG. 3.

Figure 4:
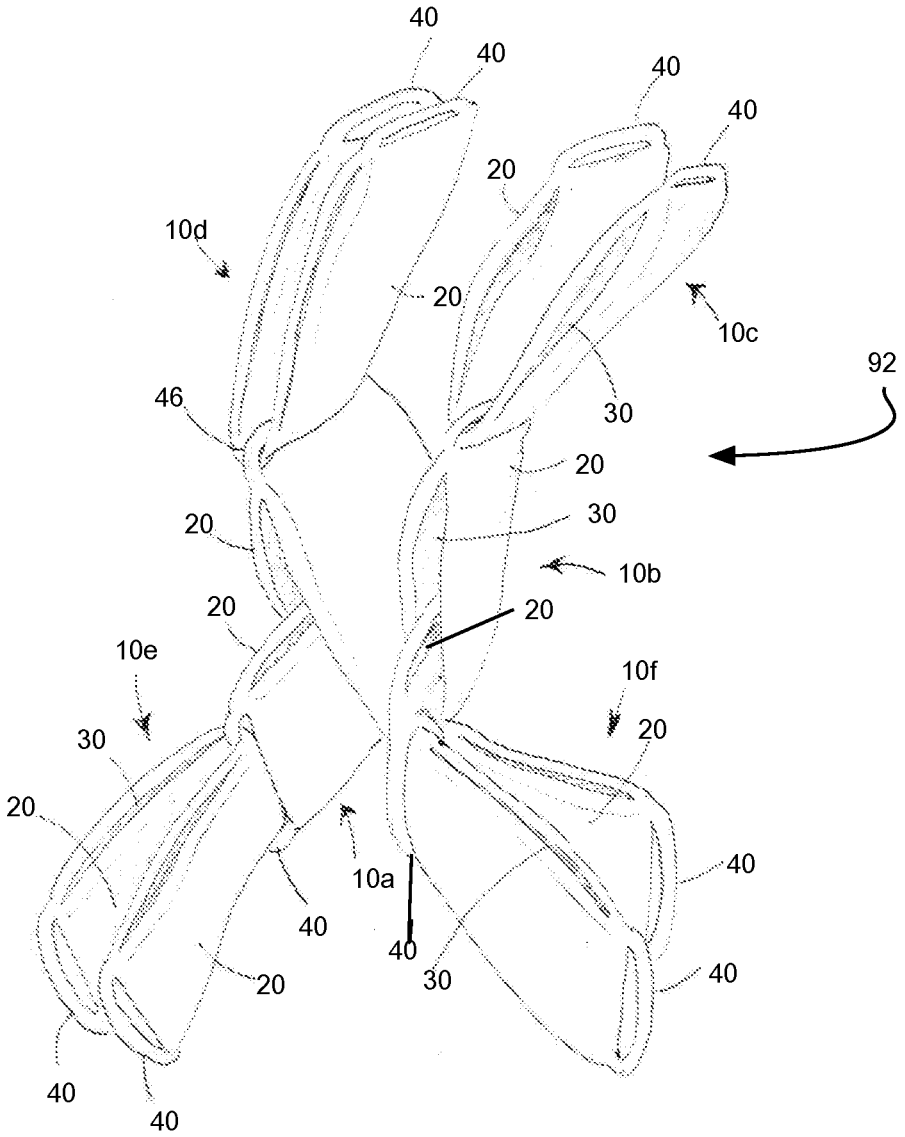
FIG. 4 is a perspective view of an example embodiment of a plurality of interlinking assembly units forming a three-dimensional object.

FIG. 4 illustrates the novelty of this device. The object 92 is started in the same manner as described herein above, with each wing 20 of the first unit 10*a* is passing through one slot 30 in the second unit 10*b*. Further units are added by inserting the wing of a third unit 10*c*, fourth unit 10*d*, fifth unit 10*e* and sixth unit 10*f* through the loops 40 of the first unit 10*a* and second unit 10*b*. The wing 20 of each unit is pulled through the loop 40 unit the loop 40 is at the inner hinge surface 46. Further building can continue by inserting additional units either through the loops 40 or the slots 20 of the initial units.

Figure 5:
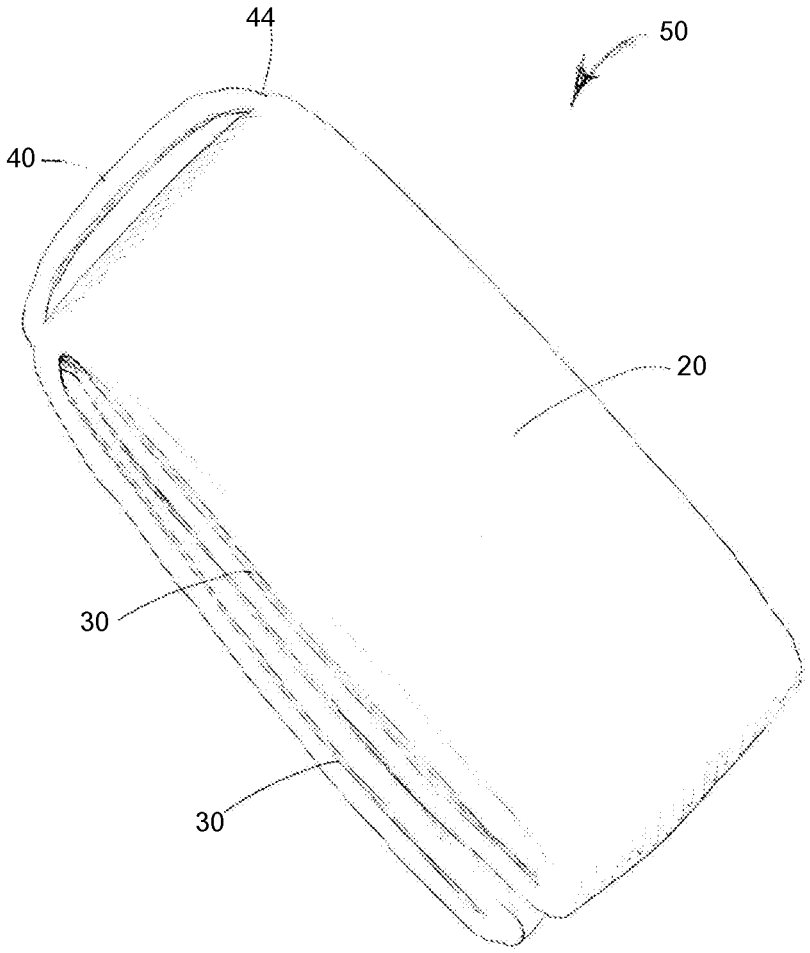
FIG. 5 is a perspective view of another example embodiment of an interlinking assembly unit.

FIG. 5 shows another example embodiment of the unit 50 that can be used with the unit disclosed hereinabove. In this example embodiment, the loop 40 attaches to the outside surface 44 of the hinge. This example embodiment unit may be used with the first example embodiment as well as with replicates of this example embodiment. The unit 50 connects to other units by inserting the wings 20 into the slots or loops of other units. Similarly, other units connect to this unit 50 by the wings inserting into the slots 30 or loops 40.

Figure 6:
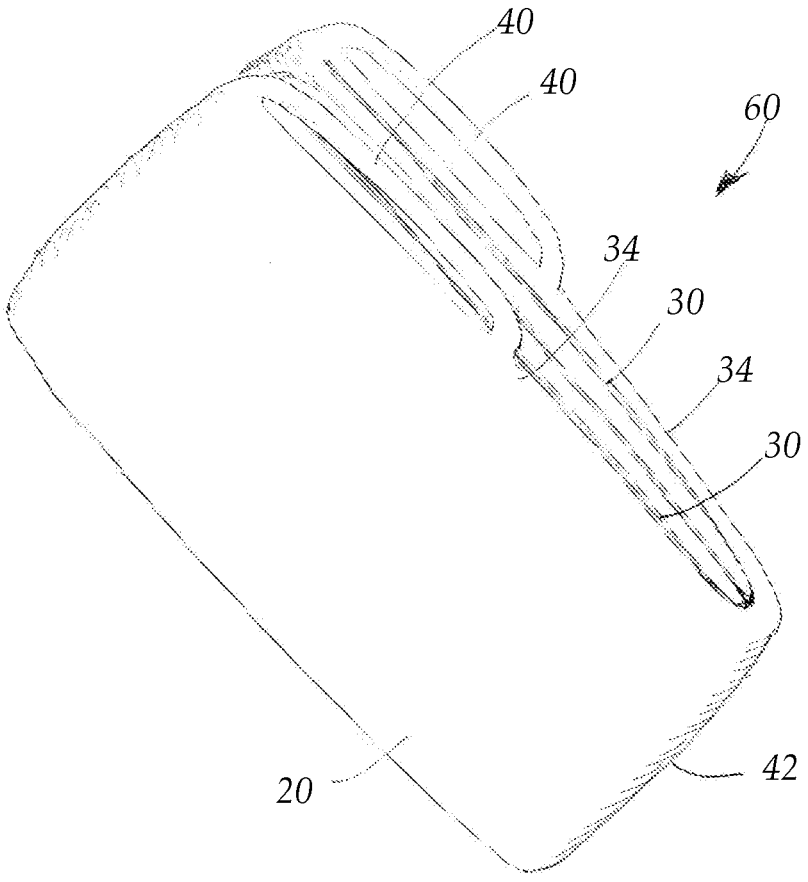
FIG. 6 is a perspective view of a further example embodiment of an interlinking assembly unit.

FIG. 6 illustrates a further example embodiment of the unit 60 that can be used with the units disclosed hereinabove. In this example embodiment, the loops 40 attach to an edge 34 of each slot 30. This example embodiment unit may be used with the first and second example embodiments as well as with replicates of this example embodiment. The unit 60 connects to other units by inserting the wings 20 into the slots or loops of other units, making sure that the hinge 42 of this unit 60 is snug against the edge 34 of the slot 30. Similarly, other units connect to this unit 60 by the wings inserting into the slots 30 or loops 40.

Figure 7:
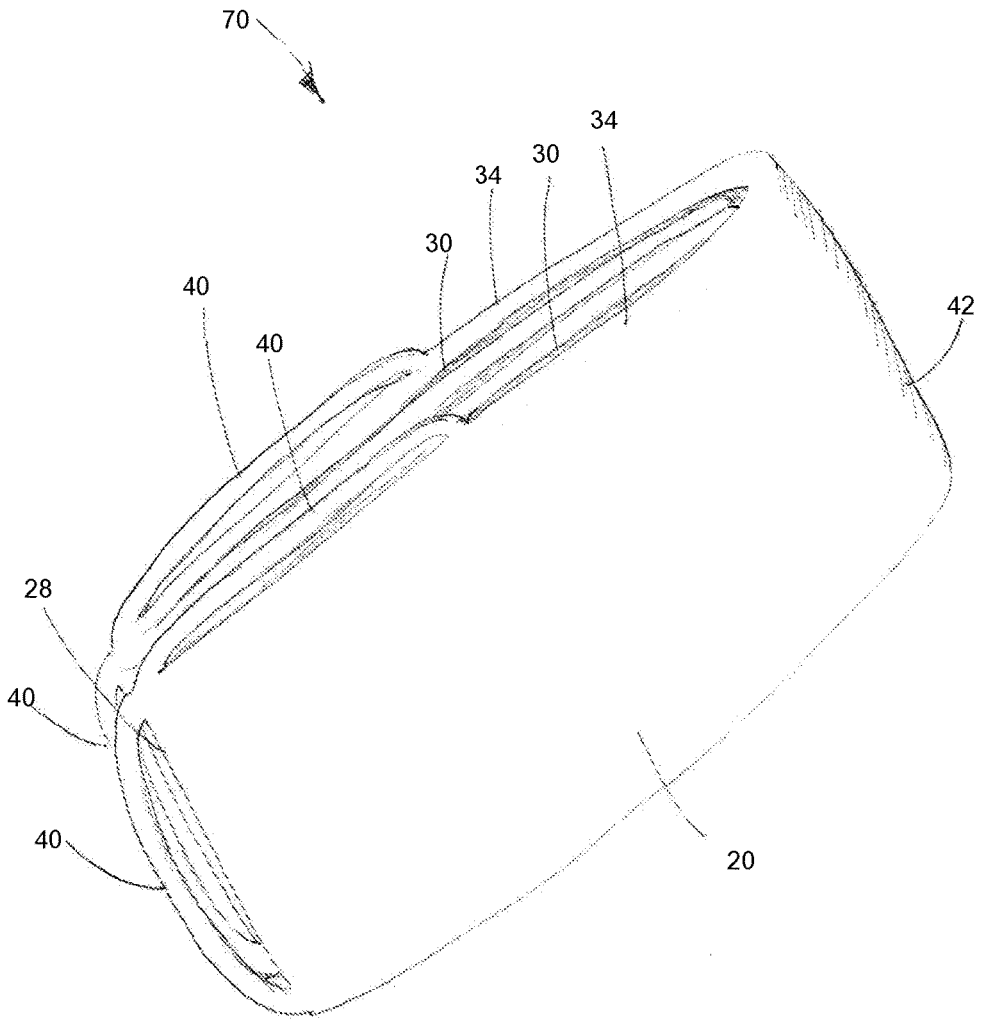
FIG. 7 is a perspective view of yet another example embodiment of an interlinking assembly unit.

In FIG. 7, yet another example embodiment of a unit 70 combines the loops 40 on the edges 34 with the loops 40 at the upper ends 28 of the wings 70. As disclosed hereinabove, this example embodiment of the unit 70 may be combined with the other example embodiments. The unit connects to other units by inserting the wings 20 into the slots or loops of other units. Similarly, other units connect to this unit 70 by the wings inserting into the slots 30 or loops 40.

Figure 8:
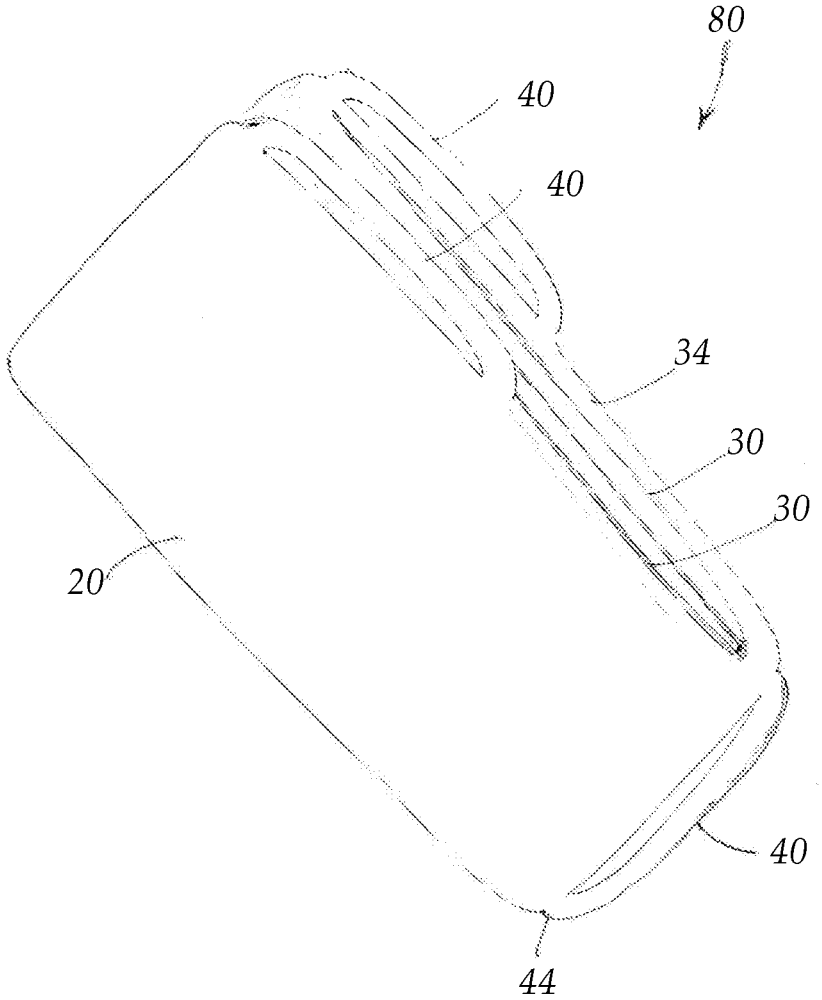
FIG. 8 is a perspective view of yet a further example embodiment of an interlinking assembly unit.

FIG. 8 discloses yet a further example embodiment of a unit 80 combining the loops 40 on the edges 34 with the loop 40 attaching to the outside surface 44 of the hinge. This unit 80 connects to other units, including replicates of this unit 80 by inserting the wings 20 into the slots or loops of other units. Similarly, other units connect to this unit 80 by the wings inserting into the slots 30 or loops 40.

Figure 9:
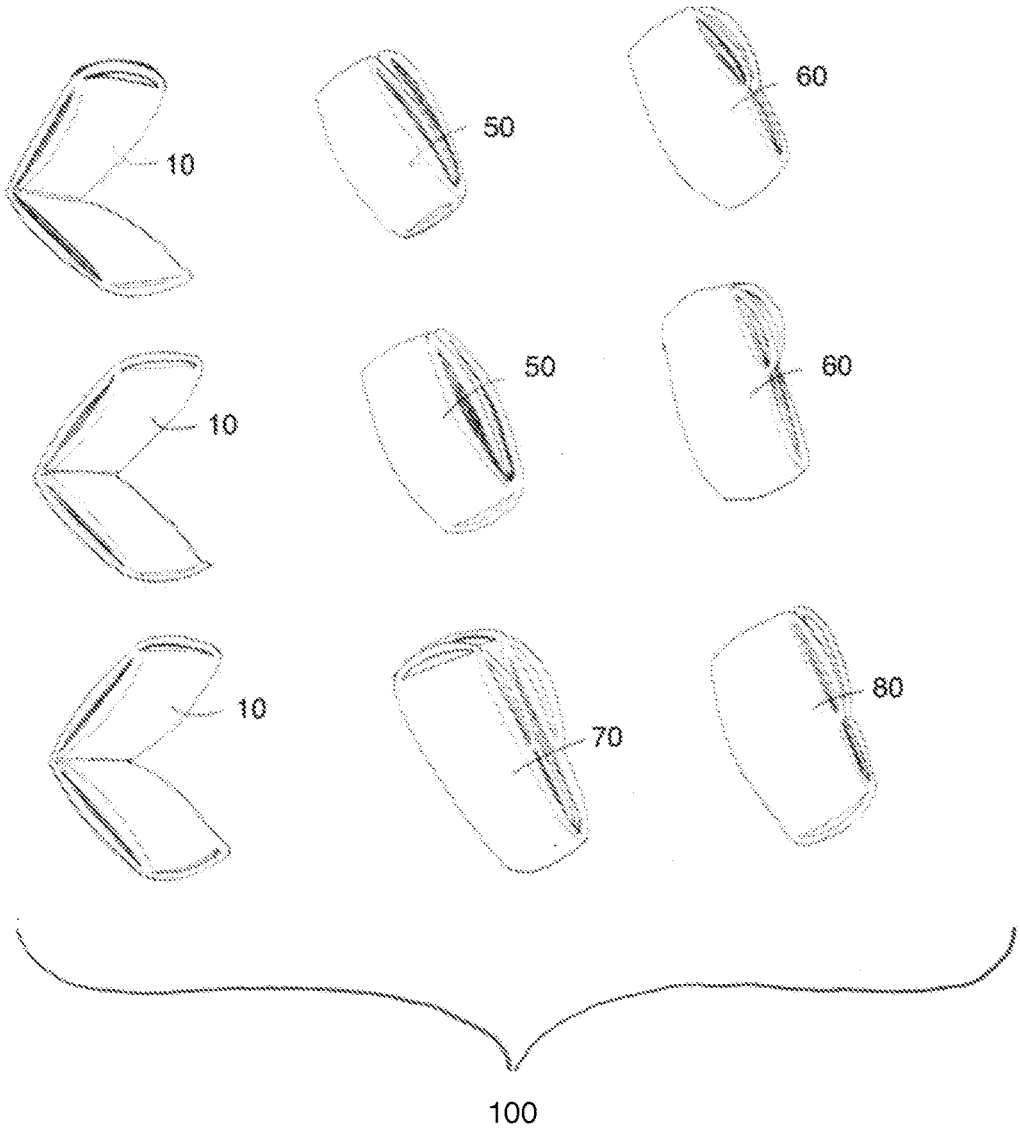
FIG. 9 is a perspective view of a kit including a plurality of example embodiments of interlinking assembly unit.

FIG. 9 shows a kit for assembling the interlocking units into an object. The kit comprises a plurality of units 10 described hereinabove. The kit may also comprise at least one unit 50. The kit may also comprise at least one unit 60. The kit may also further comprise at least one unit 70. The kit may also further comprise at least one unit 80. The kit is useful for assembling many types of functional as well as aesthetic objects such as hats, purses, cozies as well as fun objects for play. The types and function of these objects thus formed is limitless.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. Unless specifically stated or obvious from context, as used herein, the term "about" or "approximately" are understood as within a range of normal tolerance in the art.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an interlinking disclosure device. The disclosure is illustrated by example in the drawing figures, and throughout the written description. It should be understood that numerous variations are possible, while adhering to the inventive concept. Such variations are contemplated as being a part of the present disclosure.

What is claimed is:

1. An interlinking assembly unit, comprising:

a pair of wings hingedly connected, each wing having an upper end and a lower end, the lower end connecting at a hinge, each wing having a through slot extending from the upper end to the lower end, each wing having a pair of edges surrounding the slot and a pair of loops attaching to the edges, one loop on each edge; and a loop attaching to each wing.

2. The unit as described in claim 1, wherein the wing has a plurality of loops attaching to upper end of the wing and to each edge.

3. The unit as described in claim 1, wherein the wing has a plurality of loops attaching to outer surface of the hinge and to each edge.

4. A kit for assembling three-dimensional objects, comprising:

a plurality of interlinking assembly units, each unit having a pair of wings hingedly connected, each wing having an upper end and a lower end, the lower end connecting at a hinge, each wing having a through slot extending from the upper end to the lower end and each wing having a loop attaching to the upper end;

a plurality of interlinking assembly units, each unit having a pair of wings hingedly connected, each wing having an upper end and a lower end, the lower end connecting at a hinge, the hinge having an outer surface, each wing having a through slot extending from the upper end to the lower end and a loop attaches to the outer surface of the hinge; and a plurality of interlinking assembly units, each unit having a pair of wings hingedly connected, each wing having an upper end and a lower end, the lower end connecting at a hinge, each wing having a through slot extending from the upper end to the lower end, each wing having a pair of edges surrounding the slot and a pair of loops attaching to the edges, one loop on each edge.

5. An interlinking assembly unit, comprising:

a pair of substantially identical wings hingedly connected, each wing having an upper end, a lower end and a lateral axis, the lower end connecting at a hinge, the hinge having an outer surface and the loop attaches to the outer surface of the hinge, thereby attaching to each wing, each wing having a through slot extending from the upper end to the lower end, the slot having a longitudinal axis, the longitudinal axis of the slot approximately twice the lateral axis of the wing; and a loop attaching to each wing.

6. The unit as described in claim 5, wherein the wing has a pair of edges surrounding the slot and a pair of loops attaches to the edges, one loop on each edge.

7. The unit as described in claim 5, wherein the wing has a plurality of loops attaching to upper end of the wing and to each edge.

8. The unit as described in claim 5, wherein the wing has a plurality of loops attaching to outer surface of the hinge and to each edge.

* * * * *